US007902489B2

(12) United States Patent
Sirimarco et al.

(10) Patent No.: US 7,902,489 B2
(45) Date of Patent: Mar. 8, 2011

(54) TORSIONAL SPRING AIDED CONTROL ACTUATOR FOR A ROLLING MISSILE

(75) Inventors: Samuel D. Sirimarco, Tucson, AZ (US); Gerald E. Van Zee, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 433 days.

(21) Appl. No.: 12/002,374

(22) Filed: Dec. 17, 2007

(65) Prior Publication Data

US 2009/0218437 A1 Sep. 3, 2009

(51) Int. Cl.

| | |
|---|---|
| ***F42B 10/02*** | (2006.01) |
| ***F42B 15/01*** | (2006.01) |
| *F42B 10/00* | (2006.01) |
| *F42B 15/00* | (2006.01) |

(52) U.S. Cl. ..... 244/3.21; 244/3.1; 244/3.15; 244/3.23; 244/3.24

(58) Field of Classification Search ..... 244/3.1–3.3, 244/35 R, 45 R–49, 76 R, 158.1; 102/301, 102/302

See application file for complete search history.

(56) References Cited

U.S. PATENT DOCUMENTS

| | | | | | |
|---|---|---|---|---|---|
| 2,876,677 | A | * | 3/1959 | Clark et al. | 244/49 |
| 3,014,675 | A | * | 12/1961 | Lewis | 244/76 R |
| 3,272,124 | A | * | 9/1966 | Marsh et al. | 244/3.21 |
| 3,603,532 | A | * | 9/1971 | Harms | 244/3.21 |
| 3,690,596 | A | * | 9/1972 | Durran et al. | 244/3.21 |
| 3,918,664 | A | * | 11/1975 | Grosswendt | 244/3.28 |
| 4,296,894 | A | * | 10/1981 | Schnabele et al. | 244/3.27 |
| 4,549,707 | A | | 10/1985 | Daukas | |
| 4,565,340 | A | | 1/1986 | Bains | |
| 4,600,167 | A | * | 7/1986 | Kastenhuber et al. | 244/3.28 |
| 4,709,878 | A | * | 12/1987 | Titley | 244/3.28 |
| 4,714,216 | A | * | 12/1987 | Meston et al. | 244/3.29 |
| 4,842,218 | A | * | 6/1989 | Groutage et al. | 244/3.28 |
| 5,029,773 | A | * | 7/1991 | Lecat | 244/3.28 |

(Continued)

FOREIGN PATENT DOCUMENTS

WO WO-2009116978 A2 9/2009

(Continued)

OTHER PUBLICATIONS

"International Application Serial No. PCT/US2008/013558, Written Opinion mailed Aug. 14, 2009".

(Continued)

*Primary Examiner* — Bernarr E Gregory
(74) *Attorney, Agent, or Firm* — Schwegman, Lundberg & Woessner, P.A.; Gregory J. Gorrie

(57) ABSTRACT

A control actuator system. The novel system includes a control surface mounted on a body and adapted to move in a first direction relative to the body, and a first mechanism for storing energy as the control surface moves in the first direction and releasing the stored energy to move the control surface in a second direction opposite the first direction. In an illustrative embodiment, the system is adapted to rotate an aerodynamic control surface of a rolling missile, and the first mechanism is a torsional spring arranged such that rotating the control surface in the first direction winds up the spring and releasing the spring causes the control surface to oscillate back and forth, alternating between the first and second directions. In a preferred embodiment, the spring has a spring constant such that the control surface oscillates at a natural frequency matching a roll rate of the missile.

23 Claims, 5 Drawing Sheets

U.S. PATENT DOCUMENTS

| | | | | | |
|---|---|---|---|---|---|
| 5,065,956 | A | * | 11/1991 | Fattal | 244/3.2 |
| 5,437,230 | A | * | 8/1995 | Harris et al. | 102/302 |
| 5,551,793 | A | * | 9/1996 | Lewis | 244/3.25 |
| 5,671,899 | A | * | 9/1997 | Nicholas et al. | 244/49 |
| 5,992,796 | A | * | 11/1999 | Smith | 244/46 |
| 6,073,880 | A | * | 6/2000 | Voigt et al. | 244/3.28 |
| 6,186,442 | B1 | * | 2/2001 | Bittle | 244/3.29 |
| 6,726,147 | B1 | * | 4/2004 | Perini et al. | 244/3.27 |
| 6,923,404 | B1 | * | 8/2005 | Liu et al. | 244/46 |
| 2005/0211827 | A1 | | 9/2005 | Barocela | |

FOREIGN PATENT DOCUMENTS

| | | | |
|---|---|---|---|
| WO | WO-2009116978 | A3 | 12/2009 |
| WO | WO-2009116978 | A4 | 4/2010 |

OTHER PUBLICATIONS

"International Application Serial No. PCT/US2008/013558, Search Report mailed Aug. 14, 2009".

* cited by examiner

TORSIONAL SPRING AIDED CONTROL ACTUATOR FOR A ROLLING MISSILE

BACKGROUND OF THE INVENTION

1. Field of the Invention

The present invention relates to actuators. More specifically, the present invention relates to control actuator systems for rolling missiles.

2. Description of Related Art

Future concepts for highly maneuverable tactical missiles require high performance airframes controlled by very high performance control actuator systems (CAS). Missile maneuvering is traditionally controlled using a cruciform arrangement of four aerodynamic control surfaces (e.g., control fins) with four actuator motors and gear trains that independently control the aerodynamic control surfaces. Conventional missile control actuator systems, however, can have very high power requirements, especially for missiles with a rolling airframe.

Rolling airframe missiles are designed to roll or rotate about their longitudinal axes at a desired rate (typically about 5 to 15 revolutions per second), usually to gain various advantages in the design of the missile control system. Small, rolling airframes, however, exacerbate CAS power density requirements, as the control fins must be driven to large amplitudes at the roll frequency of the missile to produce large maneuvers. In contrast with standard non-rolling missiles, rolling airframe missiles require constant movement of the control fins, thus expending energy throughout the flight. The required power increases linearly with roll rate and deflection angle. In order to achieve the high maneuverability desired in new missile designs, conventional control actuator systems would require power densities that are beyond those fielded in current missile systems.

Most prior approaches for reducing the power requirements of a control actuator system in a rolling missile have centered around minimizing hinge moments (due to aerodynamic loads), minimizing inertias at the control surface, and optimizing CAS design parameters. High gear ratio designs require very high CAS motor accelerations and speeds, leading to high current, high voltage motor designs. As the gear ratios are reduced, CAS motor speeds are reduced but CAS torque requirements increase as the control surfaces have more influence (inertia and hinge moments) on the CAS motor. Attempts to minimize hinge moments through hinge line placement are not always realized as the control surface center of pressure moves around with mach number. The typical solution has been to design the CAS to meet the power (torque/speed) requirements, even if excessive, and size the flight battery/power supplies accordingly.

Hence, a need exists in the art for an improved control actuator system for rolling missiles that requires less power than prior approaches.

SUMMARY OF THE INVENTION

The need in the art is addressed by the control actuator system of the present invention. The novel system includes a control surface mounted on a body and adapted to move in a first direction relative to the body, and a first mechanism for storing energy as the control surface moves in the first direction and releasing the stored energy to move the control surface in a second direction opposite the first direction. In an illustrative embodiment, the system is adapted to rotate an aerodynamic control surface of a rolling missile, and the first mechanism is a torsional spring arranged such that rotating the control surface in the first direction winds up the spring and releasing the spring causes the control surface to oscillate back and forth, alternating between the first and second directions. In a preferred embodiment, the spring has a spring constant such that the control surface oscillates at a natural frequency matching a roll rate of the missile. The system may also include a servo motor for providing an initial torque to rotate the control surface in the first direction, and for periodically adding energy to the system such that the control surface continues oscillating to a desired angle and phase.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
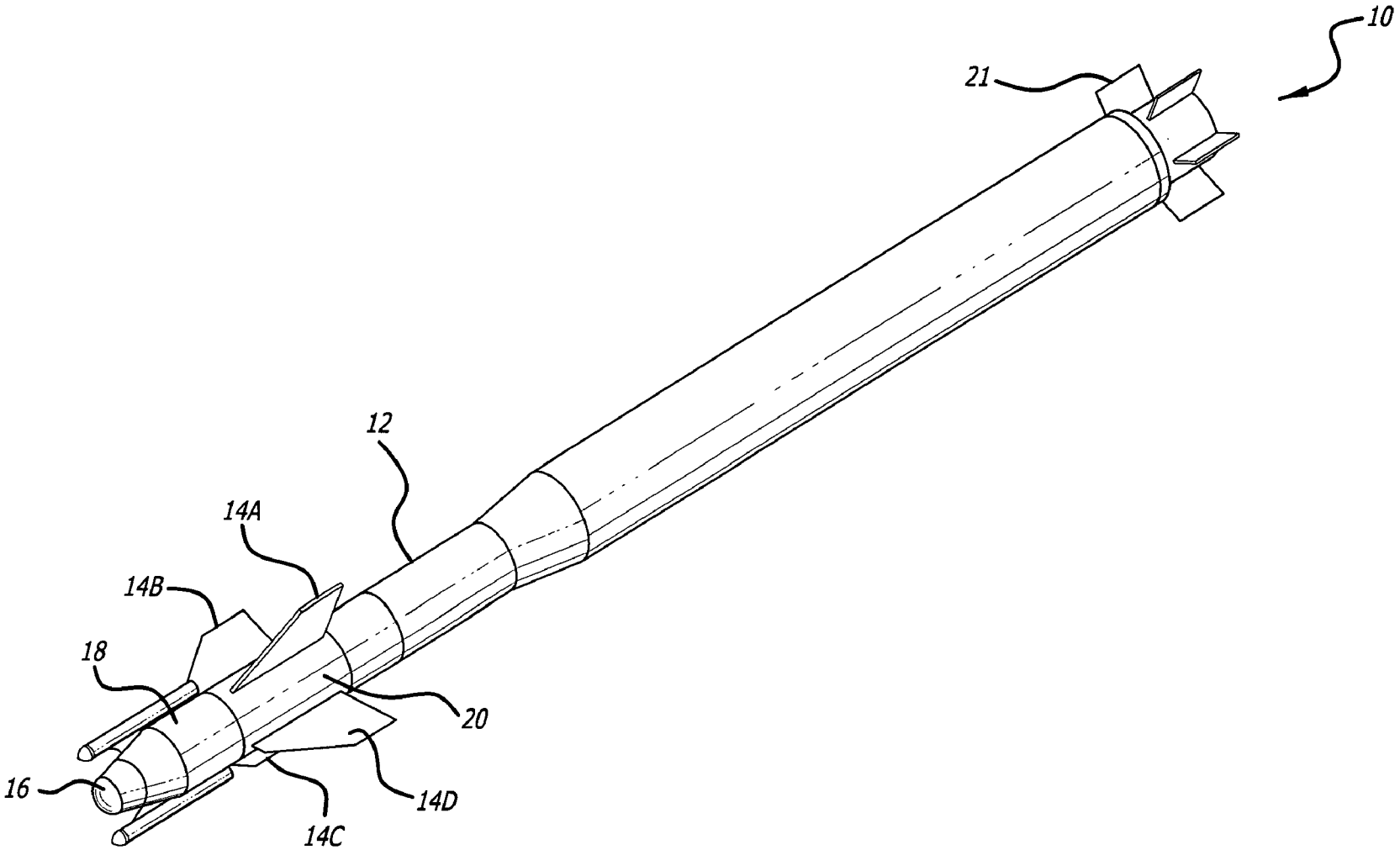
FIG. 1 is a three-dimensional view of a rolling airframe missile designed in accordance with an illustrative embodiment of the present teachings.

FIG. 1 is a three-dimensional view of a rolling airframe missile 10 designed in accordance with an illustrative embodiment of the present teachings. The missile 10 includes a missile body (or airframe) 12 and a plurality of control fins 14 for controlling the aerodynamic maneuvering of the missile 10 (four fins 14A, 14B, 14C, and 14D are shown in the illustrative embodiment of FIG. 1). The missile is adapted to roll about its longitudinal axis at a predetermined rate. The missile roll rate may be controlled by the missile launcher and/or by the control fins 14 or by canted tail fins 21 (the illustrative embodiment of FIG. 1 includes six tail fins 21).

The missile body 12 houses a seeker 16, guidance system 18, and a novel control actuator system 20. The seeker 14 tracks a designated target and measures the direction to the target. The guidance system 16 uses the seeker measurements to guide the missile 10 toward the target, generating control signals that are used by the actuator system 20 to control the movement of the fins 14. In the illustrative embodiment, the missile 10 includes four control fins 14 located in the middle of the missile 10, spaced equally around the circumference of the missile 10 and arranged in a cross-like configuration.

Each control fin 14 is controlled independently by a different actuator motor and gear train of the control actuator system 20.

In a rolling missile, the control fins 14 are driven at the roll frequency of the missile 10 to produce a maneuver in a single plane. In a standard non-rolling missile, in order to move the missile in a particular direction, the control fins are held at a fixed deflection angle. For example, to move the missile left at an angle of 10°, the top and bottom fins 14A and 14C would be rotated to the left at an angle of 10° (i.e., fin 14A rotated 10° counter-clockwise and fin 14C rotated 10° clockwise). To perform the same maneuver in a rolling missile 10, the control fins 12 are moved back and forth (between +10°and −10°) at the roll frequency of the missile 10, so that when the missile 10 rolls upside-down the fins are pointed left (fin 14A rotated 10° clockwise and fin 14C rotated 10° counter-clockwise) and when the missile 10 rolls back to its original orientation (as depicted in FIG. 1) the fins are again pointing left (fin 14A rotated 10° counter-clockwise and fin 14C rotated 10° clockwise). Thus, for a steady state maneuver, the control fins 14 are moved in a sinusoidal motion to produce the desired airframe motion. It is the acceleration term of this sinusoidal motion that drives the power requirements of a conventional rolling missile control actuator system.

The present invention employs the idea of a spring-mass system to store energy and restore the energy back into the system, greatly reducing the overall power requirements for the CAS and CAS battery in a rolling missile. The moments of inertia of the control fin, gears, and motor act as the "mass" of this system. In accordance with the teachings of the present invention, a torsional spring is added to provide a restoring torque such that the natural frequency of the spring-mass system matches the desired roll rate of the rolling missile. The torsional spring can be attached either to the output shaft (attached to the control surface) or to an adjunct gear.

Figure 2:
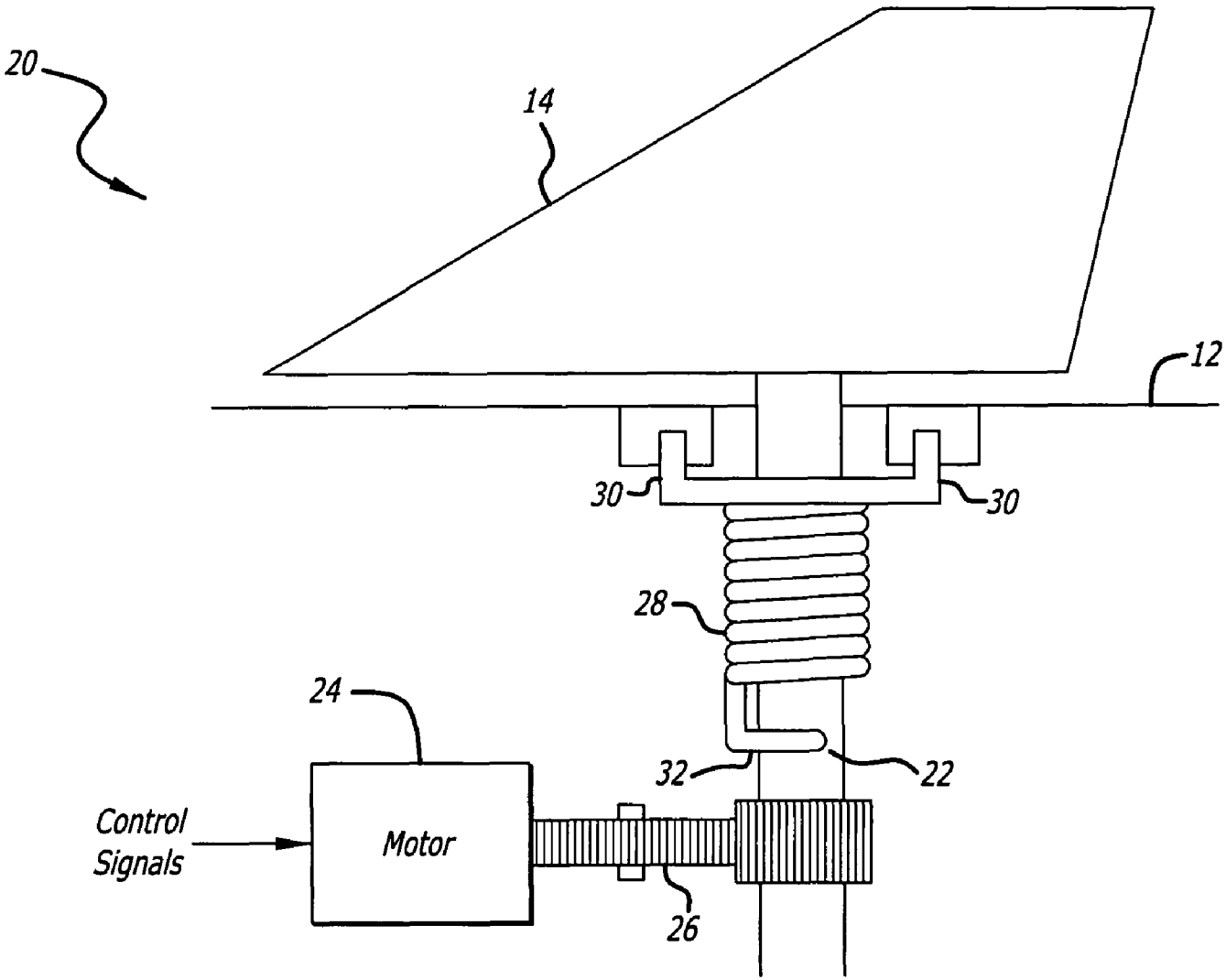
FIG. 2 is a simplified diagram of a control fin and control actuator system designed in accordance with an illustrative embodiment of the present teachings.
Figure 3:
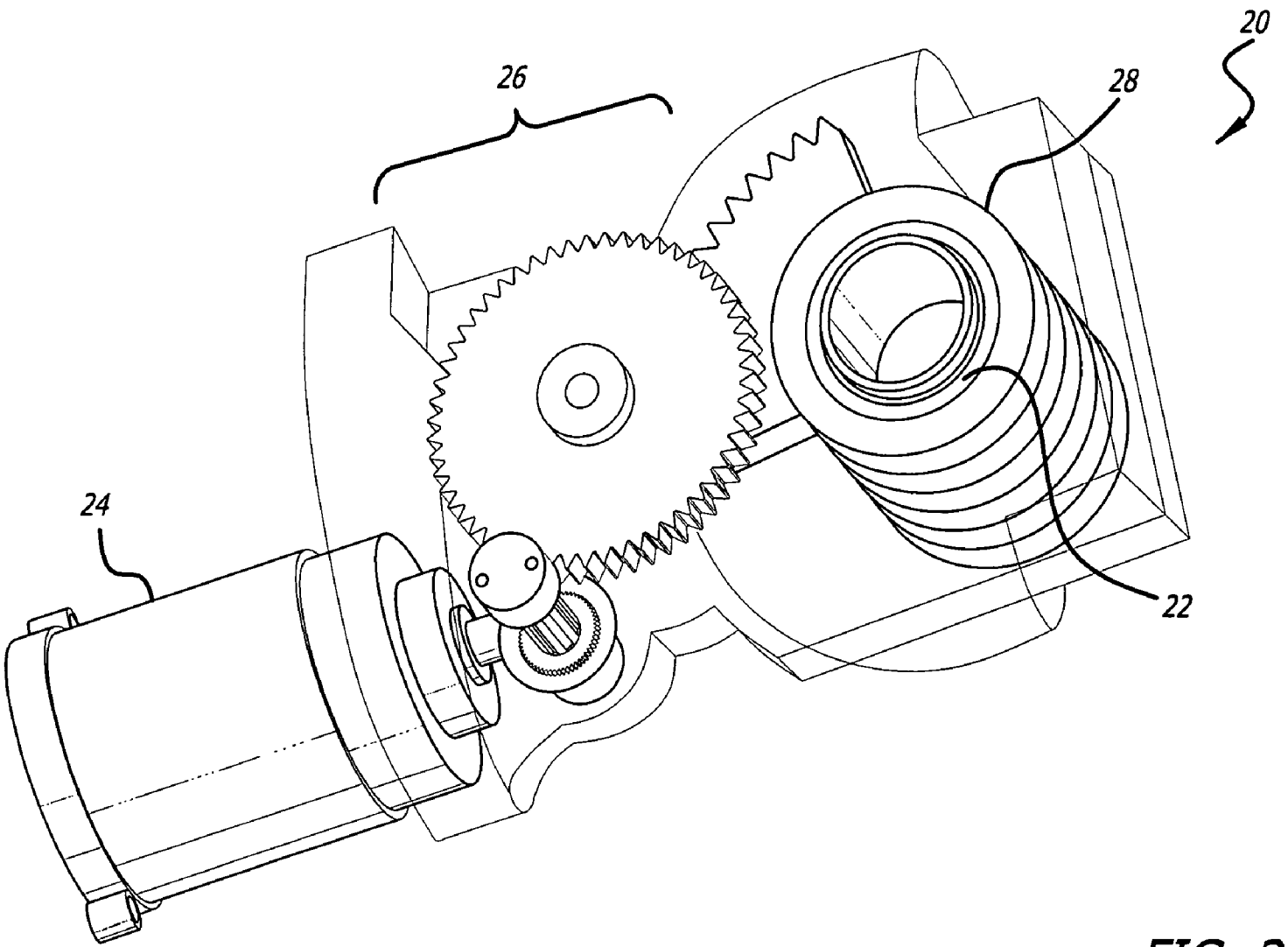
FIG. 3 is a three-dimensional view of a control actuator system designed in accordance with an illustrative embodiment of the present teachings.

FIG. 2 is a simplified diagram of a control fin 14 and associated control actuator system 20 designed in accordance with an illustrative embodiment of the present teachings. FIG. 3 is a three-dimensional view of the actuator system 20 designed in accordance with an illustrative embodiment of the present teachings. For simplicity, FIGS. 2 and 3 show an actuator system 20 for controlling only one fin 14. The system 20 may also be adapted to control additional fins.

The novel control actuator system 20 includes an output fin shaft 22, servo motor 24, gear train 26, and spring 28. The control fin 14 is attached to the fin shaft 22 such that when the shaft 22 rotates (about the longitudinal axis of the shaft 22), the fin 14 also rotates. The shaft 22 is normal to the longitudinal axis of the missile. A servo motor 24 provides a torque to rotate the shaft 22 in response to control signals from the guidance system. The gear train 26 couples the motor to the fin shaft 22.

In accordance with the present teachings, the control actuator system 20 also includes a torsional spring 28. One end 30 of the spring 28 is attached to the missile body 12, or some other component of the missile 12 such that the spring end 30 is fixed and does not rotate with the shaft 22. The other end 32 of the spring 28 is attached to the fin shaft 22 such that rotating the shaft 22 winds or unwinds the spring 28. In the illustrative embodiment, the spring 28 is in a neutral position (no tension) when the fin 14 is in line with the missile body 12. Rotating the fin 14 in a first direction winds the spring 28, and rotating the fin 14 in the opposite direction unwinds the spring 28.

The present invention takes advantage of the fact that in a rolling missile 10, the control fins 14 move in a cyclical fashion, moving back and forth at the roll frequency of the missile 10. In a conventional actuator system, the servo motor requires a large amount of power to constantly rotate the fins 14 back and forth in this manner. In accordance with the teachings of the present invention, a spring 28 is added to the actuator system 20 to store some of the energy used to rotate the fin 14 in the first direction. The stored energy is then released to rotate the fin 14 back in the opposite direction, causing the fin 14 to oscillate back and forth at the natural frequency of the system. By choosing a spring 28 with an appropriate spring constant, the natural frequency of the system can be made to match the roll frequency of the missile 10.

An actuator system 20 designed in accordance with the present teachings can therefore control the fins 14 of a rolling missile 10 with reduced power requirements than prior approaches. With this actuator system 20, it may take a little more energy from the motor 24 to rotate the fin 14 (and wind up the spring 28) the first time, but the fin 14 will then continue to oscillate with very little additional energy from the motor 24 (a little energy may need to be added periodically to compensate for friction). The servo motor 24 may include a feedback system adapted to measure the output angle of the fin 14 and add additional torque as needed to keep the fin 14 oscillating to the desired deflection angles.

Figure 4:
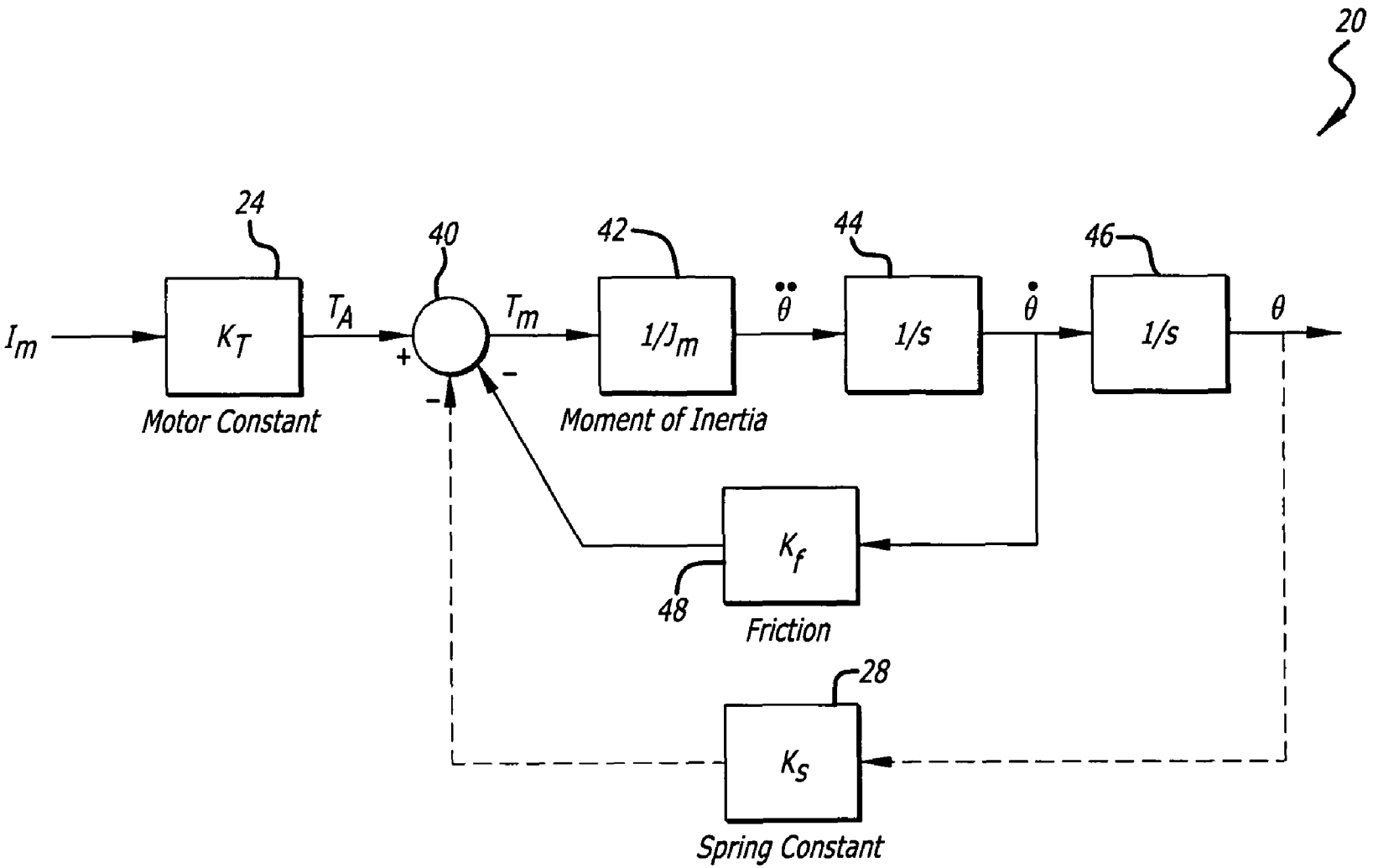
FIG. 4 is a simplified block diagram representing a control actuator system designed in accordance with an illustrative embodiment of the present teachings.

FIG. 4 is a simplified block diagram representing a control actuator system 20 designed in accordance with an illustrative embodiment of the present teachings. The block diagram shown is a mathematical model of the system 20, showing the signal flow from an input current $I_m$ applied to the servo motor 24 to the resultant rotational angle θ of the fin 14 (where the angle θ is measured with respect to the centerline of the missile 10).

In the mathematical model of FIG. 4, a current $I_m$ is input to the motor 24, which is represented by its motor constant $K_T$, resulting in the motor 24 generating a torque $T_A$. Additional torque contributions due to friction 48 (represented by the friction constant $K_f$) and the torsional spring 28 (represented by the spring constant $K_s$) are subtracted from the applied torque $T_A$ at a summing node 40 to form the total torque $T_m$ in the system. The total torque $T_m$ is applied to the overall moment of inertia $J_m$ of the system, represented by block 42, resulting in the angular acceleration $\ddot{\theta}$ of the fin 14. The overall moment of inertia $J_m$ includes the moments of inertia of the control fin 14, shaft 22, gear train 26, and motor 24. Integration of the angular acceleration $\ddot{\theta}$ at block 44 results in the rotational rate $\dot{\theta}$ of the fin 14. The torque contribution due to friction 48 is a function of the rotational rate $\dot{\theta}$. Integration of the rotational rate $\dot{\theta}$ at block 46 results in the output angle θ of the fin 14. The torque contribution due to the spring 28 is a function of the angle θ.

The dotted line in FIG. 4 represents the addition of the torsional spring 28 in accordance with the present teachings. The system without the block 28 representing the torsional spring will be referred to as the "baseline design". The transfer function of the system of the baseline design can be written as:

$$\left.\frac{\theta}{I_m}\right|_{Baseline} = \frac{\frac{K_T}{J_m}}{s\cdot\left(s+\frac{K_f}{J_m}\right)} \quad [1]$$

The transfer function of the system 20 with the added torsional spring 28 can be written as:

$$\left.\frac{\theta}{I_m}\right|_{Spring} = \frac{\frac{K_T}{J_m}}{s^2 + \frac{K_f}{J_m}s + \frac{K_S}{J_m}} \quad [2]$$

The ratio of the motor currents in the system 20 of the present invention (with the torsional spring 28) relative to the baseline design can therefore be found by dividing Eqn. 2 into Eqn. 1:

$$\frac{\left.\frac{\theta}{I_m}\right|_{Baseline}}{\left.\frac{\theta}{I_m}\right|_{Spring}} = \frac{\frac{\frac{K_T}{J_m}}{s\cdot\left(s + \frac{K_f}{J_m}\right)}}{\frac{\frac{K_T}{J_m}}{s^2 + \frac{K_f}{J_m}s + \frac{K_S}{J_m}}} \quad [3]$$

$$\frac{I_{m_Spring}}{I_{m_Baseline}} = \frac{s^2 + \frac{K_f}{J_m}s + \frac{K_S}{J_m}}{s\cdot\left(s + \frac{K_f}{J_m}\right)}$$

In accordance with the present teachings, the spring constant, $K_S$, is chosen to set the natural frequency of the system 20 to the desired operating frequency of the system 20. In the case of a rolling airframe missile 10, the operating frequency is the roll frequency of the airframe, denoted $\omega_{roll}$. The natural frequency of the torsional-spring-mass system is given by:

$$\omega_{natural} = \sqrt{\frac{K_S}{J_m}} = \omega_{roll} \quad [4]$$

With this condition set, the transfer function in Eqn. 3 can be evaluated at the operating frequency, $s=j\omega_{roll}$, resulting in:

$$\left.\frac{I_{m_Spring}}{I_{m_Baseline}}\right|_{s=j\omega_{roll}} = \frac{-\frac{K_S}{J_m} + \frac{K_f}{J_m}s + \frac{K_S}{J_m}}{s\cdot\left(s + \frac{K_f}{J_m}\right)} \quad [5]$$

$$\left.\frac{I_{m_Spring}}{I_{m_Baseline}}\right|_{s=j\omega_{roll}} = \frac{\frac{K_f}{J_m}s}{s\cdot\left(s + \frac{K_f}{J_m}\right)}$$

$$\left.\frac{I_{m_Spring}}{I_{m_Baseline}}\right|_{s=j\omega_{roll}} = \frac{\frac{K_f}{J_m}}{j\sqrt{\frac{K_S}{J_m}} + \frac{K_f}{J_m}}$$

The magnitude of the function can be taken as:

$$\left|\left.\frac{I_{m_Spring}}{I_{m_Baseline}}\right|_{s=j\omega_{roll}}\right| = \left|\frac{\frac{K_f}{J_m}}{j\sqrt{\frac{K_S}{J_m}} + \frac{K_f}{J_m}}\right| = \frac{\frac{K_f}{J_m}}{\sqrt{\frac{K_S}{J_m} + \left(\frac{K_f}{J_m}\right)^2}} \quad [6]$$

The power dissipated in the servo motor 24 is proportional to the square of the motor current $I_m$. Therefore, the ratio of power dissipated in the torsional-spring-mass design of the present invention versus the baseline design can be expressed as:

$$\frac{Power_{Spring}}{Power_{Baseline}} = \left[\frac{\frac{K_f}{J_m}}{\sqrt{\frac{K_S}{J_m} + \left(\frac{K_f}{J_m}\right)^2}}\right]^2 \quad [7]$$

$$\frac{Power_{Spring}}{Power_{Baseline}} = \frac{\left(\frac{K_f}{J_m}\right)^2}{\frac{K_S}{J_m} + \left(\frac{K_f}{J_m}\right)^2}$$

$$\frac{Power_{Spring}}{Power_{Baseline}} = \frac{1}{\frac{K_S J_m}{K_f^2} + 1}$$

The term $K_S J_m / K_f^2$ is typically greater than one. Therefore, a torsional-spring-mass system designed in accordance with the present teachings should consume less power than the baseline system.

As a numerical example, consider a system with the following parameters:

$K_T$=0.028Nm/A $J_m$=284$e^{-6}$Nm-s$^2$ $K_f$=0.0089Nm-s $\omega_{roll}$=2π10rad/s To satisfy the condition that the natural frequency of the system is equal to the roll frequency of the airframe, the spring constant $K_S$ is chosen to be:

$$\sqrt{\frac{K_S}{J_m}} = \omega_{roll}$$

$$K_S = J_m \cdot \omega_{roll}^2$$

$$K_S = (284e-6)\cdot(2\pi\cdot 10)^2 \text{ Nm/rad}$$

$$K_S = 1.12 \text{ Nm/rad}$$

Plugging these values into Eqn. 7 gives the result that the power dissipation in the actuator system 20 with the addition of the torsional spring 28 relative to the baseline design is:

$$\frac{Power_{Spring}}{Power_{Baseline}} = \frac{1}{\frac{K_S J_m}{K_f^2} + 1}$$

$$\frac{Power_{Spring}}{Power_{Baseline}} = \frac{1}{\frac{(1.12)(284e-6)}{0.0089^2} + 1}$$

$$\frac{Power_{Spring}}{Power_{Baseline}} = 0.2$$

Thus, in the numerical example, the addition of a torsional spring 28 (with an appropriate spring constant $K_S$) to the control actuator system 20 should reduce the power dissipation by 80%.

Figure 5:
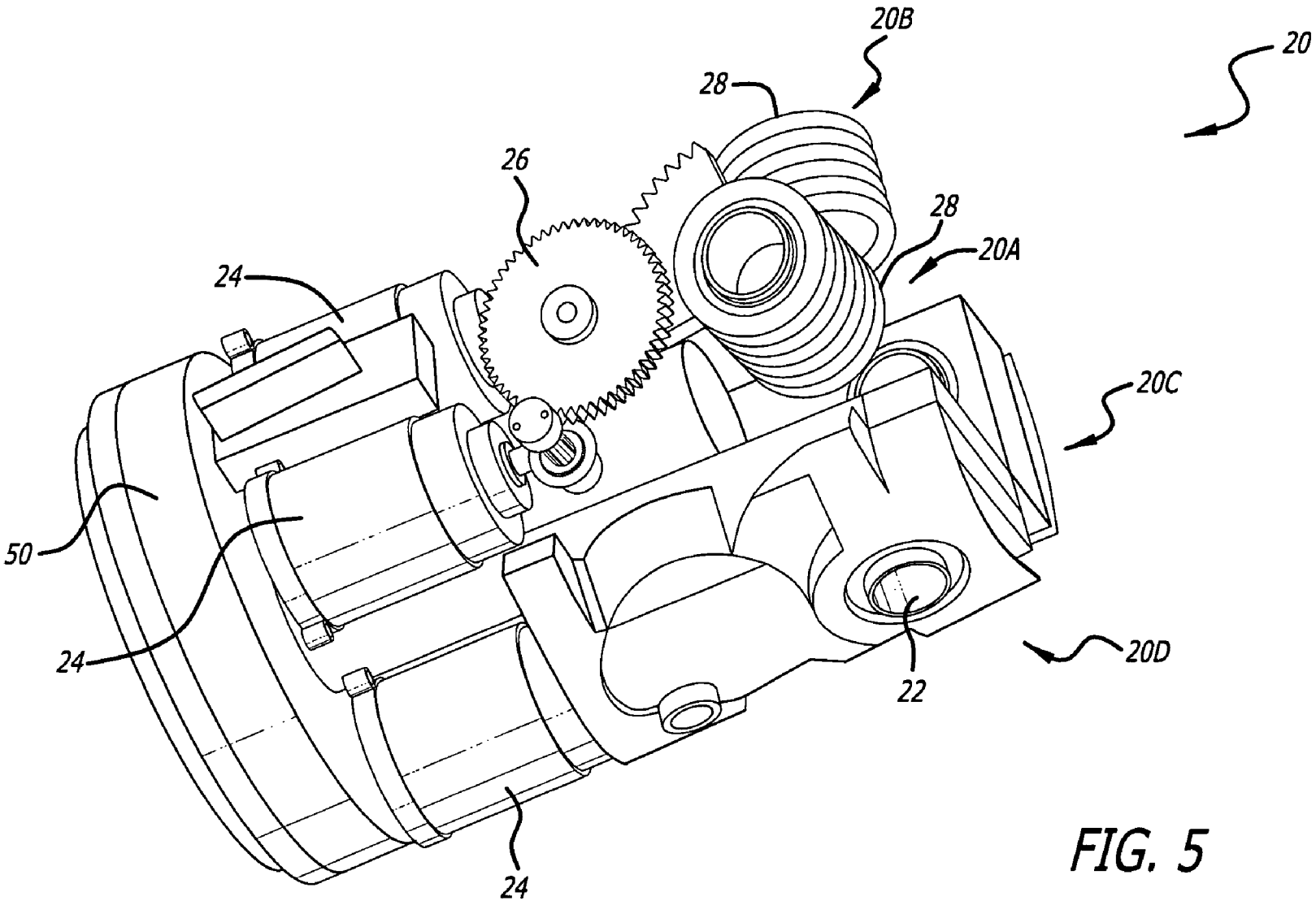
FIG. 5 is a three-dimensional view of a control actuator system for four control fins designed in accordance with an illustrative embodiment of the present teachings.

FIGS. 2-4 showed an actuator system 20 for controlling only one fin 14. In the illustrative embodiment of FIG. 1, the missile 10 includes four fins 14A-14D. FIG. 5 is a three-dimensional view of a control actuator system 20 for four control fins designed in accordance with an illustrative embodiment of the present teachings. In this embodiment, each fin 14A-14D is controlled independently by a separate actuator 20A-20D, respectively. Each individual actuator 20A-20D includes a servo motor 24, gear train 26, fin shaft 22, and torsional spring 28, as shown in FIGS. 2 and 3. The actuator system 20 may also include electronics 50 for providing the drive currents $I_m$ for the servo motors 24.

Alternatively, a single actuator (as shown in FIG. 3) may be used to control multiple fins simultaneously. For example, a missile having only two control fins may include two separate actuators for independently controlling the two fins, or it may include only one actuator for rotating one fin shaft that is coupled to both fins (in this embodiment, the two fins would move together in unison). Other implementations may also be used without departing from the scope of the present teachings.

Thus, the present invention has been described herein with reference to a particular embodiment for a particular application. Those having ordinary skill in the art and access to the present teachings will recognize additional modifications, applications and embodiments within the scope thereof. For example, while the invention has been described with reference to a rolling missile, the present teachings may also be applied to other applications such as a rocket or other air or space vehicle or projectile, a torpedo or other watercraft, or a high speed ground vehicle.

It is therefore intended by the appended claims to cover any and all such applications, modifications and embodiments within the scope of the present invention.

What is claimed is:

1. A control actuator system for a rolling missile, the control actuator system comprising:

a control surface mounted on a body of the rolling missile and adapted to rotate about an axis normal to said body;

a torsional spring coupled to the control surface to cause the control surface to oscillate back and forth about the axis; and a servo motor to provide a torque to maintain oscillation of the control surface at a roll frequency of the body.

2. The control actuator system of claim 1 wherein the servo motor is coupled to a feedback system to measure an angle of the control surface and add additional torque to maintain the oscillation of the control surface at a roll frequency of the body.

3. The control actuator system of claim 2 wherein the torsional spring is to store energy as the control surface moves in a first direction and is to release energy and move the control surface in a second direction opposite the first direction.

4. The control actuator system of claim 3 wherein said spring is arranged such that rotating said control surface in said first direction winds up said spring.

5. The control actuator system of claim 4 wherein a first end of said spring is coupled to said control surface and adapted to rotate with said control surface.

6. The control actuator system of claim 5 wherein a second end of said spring is coupled to said body such that said second end does not rotate with said control surface.

7. The control actuator system of claim 3 wherein said spring is adapted to oscillate said control surface back and forth, alternating between said first and second directions.

8. The control actuator system of claim 2 wherein said spring has a spring constant selected to match at a natural frequency of said control actuator system to the roll frequency of the body.

9. The control actuator system of claim 8 wherein said control surface is an aerodynamic control surface for the rolling missile.

10. The control actuator system of claim 9 wherein said roll frequency of the body is a roll rate of said missile.

11. The control actuator system of claim 10 further comprising a shaft coupled to said control surface such that rotating said shaft also rotates said control surface, wherein the servo motor is configured to rotate the shaft.

12. The control actuator system of claim 11 further comprising a gear train for coupling said motor to said shaft.

13. The control actuator system of claim 11 wherein said motor is adapted to periodically add energy to said system such that said control surface oscillates to a desired angle.

14. The control actuator system of claim 1 wherein said body is a missile airframe.

15. An actuator for rotating a control surface of a rolling missile, the actuator comprising:

a shaft coupled to said control surface such that rotating said shaft also rotates said control surface;

a servo motor for providing a torque to rotate said shaft in a first direction; and a torsional spring arranged such that rotating said shaft in said first direction winds up said spring and upon release said spring causes said control surface to rotate in a second direction opposite said first direction and oscillate back and forth between said first and second directions, wherein the servo motor is to provide torque to maintain an oscillation of the control surface at a frequency.

16. The actuator of claim 15 further comprising a feedback system to measure an angle of the control surface and cause the servo motor to add additional torque to maintain the oscillation of the control surface at the frequency.

17. The actuator of claim 16 wherein said spring has a spring constant selected to match a natural frequency of said control actuator system to the frequency.

18. A missile comprising:

a missile body adapted to roll at a desired roll rate;

one or more control fins for maneuvering said missile body;

a guidance system adapted to provide control signals for navigating said missile; and one or more actuators adapted to receive said control signals and in accordance therewith rotate said control fins, each actuator including:

a shaft coupled to a control fin such that rotating said shaft also rotates said control fin;

a servo motor for providing a torque to rotate said shaft in a first direction; and a torsional spring arranged such that rotating said shaft in said first direction winds up said spring and upon release said spring causes said control surface to rotate in a second direction opposite said first direction and oscillate back and forth between said first and second directions, wherein said spring has a spring constant such that said control fin oscillates at a natural frequency matching said roll rate, and wherein the servo motor is to provide torque to maintain an oscillation of the control surface at the roll rate.

19. The missile of claim 18 wherein the actuators include a feedback system to measure an angle of the control surface and cause the servo motor to add additional torque to maintain the oscillation of the control surface at the roll rate.

20. The missile of claim 19 wherein said spring has a spring constant selected to match the natural frequency of the actuator to the roll rate.

21. A method for rotating a control surface of a rolling missile including the steps of:

applying energy to rotate said control surface in a first direction;

storing some of said applied energy with a torsional spring; and releasing the stored energy such that said control surface rotates in a second direction opposite said first direction and continues to oscillate back and forth, alternating between said first and second directions, wherein energy is applied to maintain an oscillation of the control surface at a roll rate.

22. The method of claim 21 further comprising:

providing feedback to measure an angle of the control surface; and adding additional torque in response to the feedback to maintain the oscillation of the control surface at the roll rate.

23. The method of claim 22 wherein the method is performed by an actuator, and wherein said spring has a spring constant selected to match the natural frequency of the actuator to the roll rate.

* * * * *